US006198036B1

(12) United States Patent
Hoshino

(10) Patent No.: US 6,198,036 B1
(45) Date of Patent: Mar. 6, 2001

(54) ELECTRIC GUITAR TREMOLO BRIDGE PIEZO PICKUP

(75) Inventor: Yoshihiro Hoshino, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 09/373,641

(22) Filed: Aug. 24, 1999

(30) Foreign Application Priority Data

Sep. 25, 1998 (JP) ..... 10-271765

(51) Int. Cl.[7] ..... G10H 1/02; G10H 3/18

(52) U.S. Cl. ..... 84/731; 84/739; 84/313; 84/DIG. 24

(58) Field of Search ..... 84/731, 739, 740, 84/267, 313, DIG. 24

(56) References Cited

U.S. PATENT DOCUMENTS

| | | | | |
|---|---|---|---|---|
| 3,396,284 | | 8/1968 | Scherer . | |
| 4,135,426 | * | 1/1979 | Rickard | 84/731 X |
| 4,314,495 | | 2/1982 | Baggs . | |
| 4,911,054 | | 3/1990 | McClish . | |
| 4,911,057 | * | 3/1990 | Fishman | 84/731 |
| 5,196,641 | * | 3/1993 | Schaller | 84/740 |
| 5,637,818 | | 6/1997 | Fishman et al. . | |
| 5,696,335 | * | 12/1997 | Rose | 84/313 X |

* cited by examiner

*Primary Examiner*—Stanley J. Witkowski
(74) *Attorney, Agent, or Firm*—Ostrolenk, Faber, Gerb & Soffen, LLP

(57) ABSTRACT

An electric guitar which is equipped with a piezo pickup wherein the lengths of the strings are not changed by the rotation of the main saddle body in connection with fine tuning and during tremolo performance. The electric guitar has a piezo pickup and has a main saddle body that is held so as to be rotatably adjustable in a back and forth direction about an axle. The main saddle body is held pivotally by a saddle holding member on a base plate on the guitar body. The base plate is installed so as to freely swing with respect to the surface of the guitar body to provide a tremolo effect. The top surface of the piezo pickup constantly contacts the string that is held by the main saddle body, at least during fine tuning, by rotatable adjustment of the main saddle body and in the possible swinging range of the base plate during a tremolo performance, thereby avoiding an out of tune situation during the tremolo performance.

12 Claims, 12 Drawing Sheets

ELECTRIC GUITAR TREMOLO BRIDGE PIEZO PICKUP

BACKGROUND OF THE INVENTION

This invention relates to an electric guitar and, in particular, to an electric guitar which is equipped with a tremolo bridge and a piezo pickup. In the art, when the strings are clamped on the guitar bridge, it is called a locking tremolo.

A known electric guitar equipped with a tremolo bridge 10A is shown in FIGS. 13–16. The guitar strings are fixed between the guitar neck nut and the tremolo bridge 10A, which has a bridge saddle part, and is located on the body surface of the guitar for the purpose of preventing the guitar from becoming out-of-tune at the time of performing with a tremolo.

The tremolo bridge 10A of the known guitar comprises a base plate 11, which is pivotable for swinging motion on the surface of the body, and a bridge saddle 31A, which is held by base plate 11 for maintaining the guitar strings in a tunable state. In an electric guitar which is equipped with a tremolo bridge, it is possible to effectively carry out both intonation adjustment or string adjustment for adjusting the length of the cord and fine tuning for the adjustment of the tension (pitch) of the cord. As compared with a tremolo bridge which does not lock, the locking type can reduce any possibility of out-of-tune performance with a tremolo and, at the same time, to increase the amount of tune change during the tremolo performance.

The base plate 11 of the tremolo bridge shown in FIGS. 13–16 has a forward facing, front knife edge 12, which serves as an installation part for the base plate on the body surface of the guitar. A stud bolt 13 engages the knife edge 12 and is affixed to the body surface. A stud fixing bolt 14 and an anchor 15 for the stud bolt are provided in the guitar body. An opening or groove 16 extends along the length of the saddle body for allowing movement of a rotatable adjustment bar 47 for front and rearward movement of the bridge saddle 31A of each string. An upstanding arm receptacle 18 is provided for a tremolo arm 17. An installation member 19 installs the bridge saddle 31A on the base plate 11. A plate spring 21 biases from below against the rotatable adjustment bar 47 of the bridge saddle 31A. A tremolo block 22 is beneath the spring 21. Tremolo springs 23 bias the tremolo block 22 to return from tilting. A bracket 24 fixes the tremolo springs 23 on the guitar body, and screws 25 fasten the plate 24 to the guitar body.

When the tremolo arm 17 is shifted inward in the direction of the guitar body, the base plate 11 swings against and around the stud bolt 13, which acts as a fulcrum, in opposition to the return direction force of the tremolo springs 23. See FIG. 16. As a result, the tuning of the chord pitch of the guitar can be changed, thereby providing a tremolo effect for a modification of the sound range of the tremolo.

In addition, the bridge saddle 31A shown in FIGS. 13–16 comprises a saddle holding member 32A and a main saddle body 41. The main saddle body 41 is held to be rotatable in the front-and-back direction on the saddle holding member 32A about an axle 42 defining an axis of rotation. A cut or groove 33A in the saddle holding member 32A, shown in FIG. 14, is provided for the installation of the saddle holding member 32A on the base plate 11 to allow the member 32A also to move forward and back on the base plate 11. A fixing bolt 34A passes through a metal washer 35A, and, they are above the saddle cut 33A and fasten the saddle 31A, and an opening 36A for accommodating the front part of the main saddle body 41 allows it to move slidably with respect to base plate 11, as seen in FIG. 15.

The length adjustment of the cord S or its so-called adjustment or intonation harmonic adjustment can be carried out by loosening the fixing bolt 34A and moving the related members, including the saddle holding member 32A and the main saddle body 41, etc. back and forth in the direction of the cord or string S.

A string receiving part 43 in the main saddle body 41 has a rearwardly and downwardly curved surface at the front of the main saddle body. A concavity 44 for fixing the string, a block 45 in the concavity for string fixing, a string fixing bolt 46 for holding the string fixing block are provided. A rotatable adjustment bar 47 for the saddle, and a fine tuning bolt 48, which is in contact with the adjustment bar 47 for rotating the main saddle body 41 by its up and down movement, are also provided.

If the tip of the fine tuning bolt 48 is moved downward by rotating the bolt, the adjustment bar 47 is pressed downward against the bias of the spring 21 and the main saddle body 41 rotates in a backward direction (in the clock-wise direction in FIGS. 15(A) and 15(B)) with the axle 42 as the center of rotation so as to move from the state shown in FIG. 15(B) to the state shown in FIG. 15(A).

If the fine tuning bolt 48 is rotated to move its tip upward, the adjustment bar 47 moves upward, with the main saddle body 41 rotating against the bias of the spring 21 in a frontward direction (in the counter-clockwise direction in FIGS. 15(A) and 15(B)) and with the axle 42 serving as the center of rotation so as to move from the state shown in FIG. 15(A) to the state shown in FIG. 15(B).

The fine tuning of a specific cord or string can be carried out in this manner. Thus, the main saddle body 41 is rotated in a backward direction when the tension (pitch) of the string is to be increased and the main saddle body 41 is rotated in the frontward direction when it is to be decreased.

Because the string receiving part 43 of the main saddle body 41 has a curved surface in the above described structure, the cord S always contacts the bridge saddle 31A at the same position or, to be specific, at a position Z at the top of the axle 42 of the main saddle body 41. As a result, the contact position Z does not move in the string direction X when the main saddle body 41 rotates. Accordingly, the string length (the distance between the contact position Z for the cord S with the bridge saddle 31A and the contact position with the nut portion at the opposite neck end of the guitar) does not change during fine tuning. Since the string remains in a tightened state, moreover, the harmonic tuned state of the cord S can be maintained.

On occasions, a guitar is provided with a piezo pickup disposed in the bridge. The sound collected by the piezo pickup is used for increasing the electric amplification or for collecting high frequency sound, thereby producing natural acoustic sounds in a folk guitar with a resonant trunk. In this system, a piezoceramic is utilized for the pickup. As compared with a conventional magnetic pickup system wherein electric current is generated in the pickup by vibrations of the strings, which act as magnetic material, the piezoceramic system generates an electric current or voltage through the contraction and elongation of a piezo ceramic by the string vibrations acting as a pressure signal. When a piezo pickup is used, therefore, it becomes possible to pickup the vibrations of a nylon string, etc. which is not of a magnetic material. This is not possible with systems using magnetic pickups.

An adjustment mechanism for obtaining the sound desired by the performer, for example, a reduction in excessive high range, by accommodating an equalizer at the control part, can be provided in a guitar having a piezo pickup.

When a piezo pickup is accommodated in a folk guitar having a resonant trunk, a bar-shaped piezo pickup can be inserted and fixed between a bridge saddle made of plastic and a base plate made of wood as the bridge structure is simple and the position and the height of the bridge are basically fixed.

In an electric guitar or bass guitar having a bridge or tremolo made of metal (not of the locking tremolo type as mentioned earlier), it becomes necessary to fix a plurality of small piezo pickups at the contact part with the bridge saddle, one for each string, because the bridge saddle is divided for the strings, making it necessary to cope with the changes in height or position. To enable this piezo pickup to function satisfactorily, however, it becomes necessary to fix the entire body without obstructing the compression or elongation of the piezo pickup. Accordingly, it has not been possible to provide such guitars that are equipped with piezo pickups with a tremolo bridge.

SUMMARY OF THE INVENTION

The present invention is directed to providing a piezo pickup in the bridge saddle for each string of a tremolo bridge of a guitar. To provide the features of the tremolo bridge, however, it becomes necessary to satisfy a design requirement that the string length does not change when the main saddle body is rotated during fine tuning.

This means that the distance between the rotary axle of the main saddle body and the string contact position or the piezo pickup should not be large. It is extremely difficult to install a pickup so as to satisfy this requirement.

The present invention solves this problem. The purpose of the invention is to provide an electric guitar equipped with a piezo pickup in which the string length does not change along with rotation of the main saddle body during fine tuning.

According to one embodiment of the invention, an electric guitar is provided having a piezo pickup, a base plate, a saddle holding member on the base plate, a main saddle body disposed so as to be rotatably adjustable in a forward and a rearward direction about an axle on the saddle holding member on the base plate. The base plate is movably installed on a surface of the guitar body and is movable through a range of free swinging. The piezo pickup is in contact at all times at the top of the saddle holding member with a guitar string that is held by the main saddle body, at least in the range of free swinging of the base plate.

According to another embodiment, the invention comprises an electric guitar having a piezo pickup and a main saddle body held so as to be rotatably adjustable in a forward and backward direction about an axle on a saddle holding member disposed on the base plate. The base plate is movably installed on the surface of the guitar body and is movable through a range of free swinging. The piezo pickup at the top of the main saddle body is in contact at all times with a guitar string that is held by the main saddle body, at least in the range of free swinging of the base plate.

According to a further aspect, the piezo pickup is arranged immediately above the axle of the main saddle body.

According to still another aspect, the piezo pickup has a curved surface around an axis parallel to the axle for contact with the guitar string.

BRIEF DESCRIPTION OF THE DRAWINGS

The invention is described with reference to the drawings in which.

DETAILED DESCRIPTION OF THE INVENTION

Figure 1:
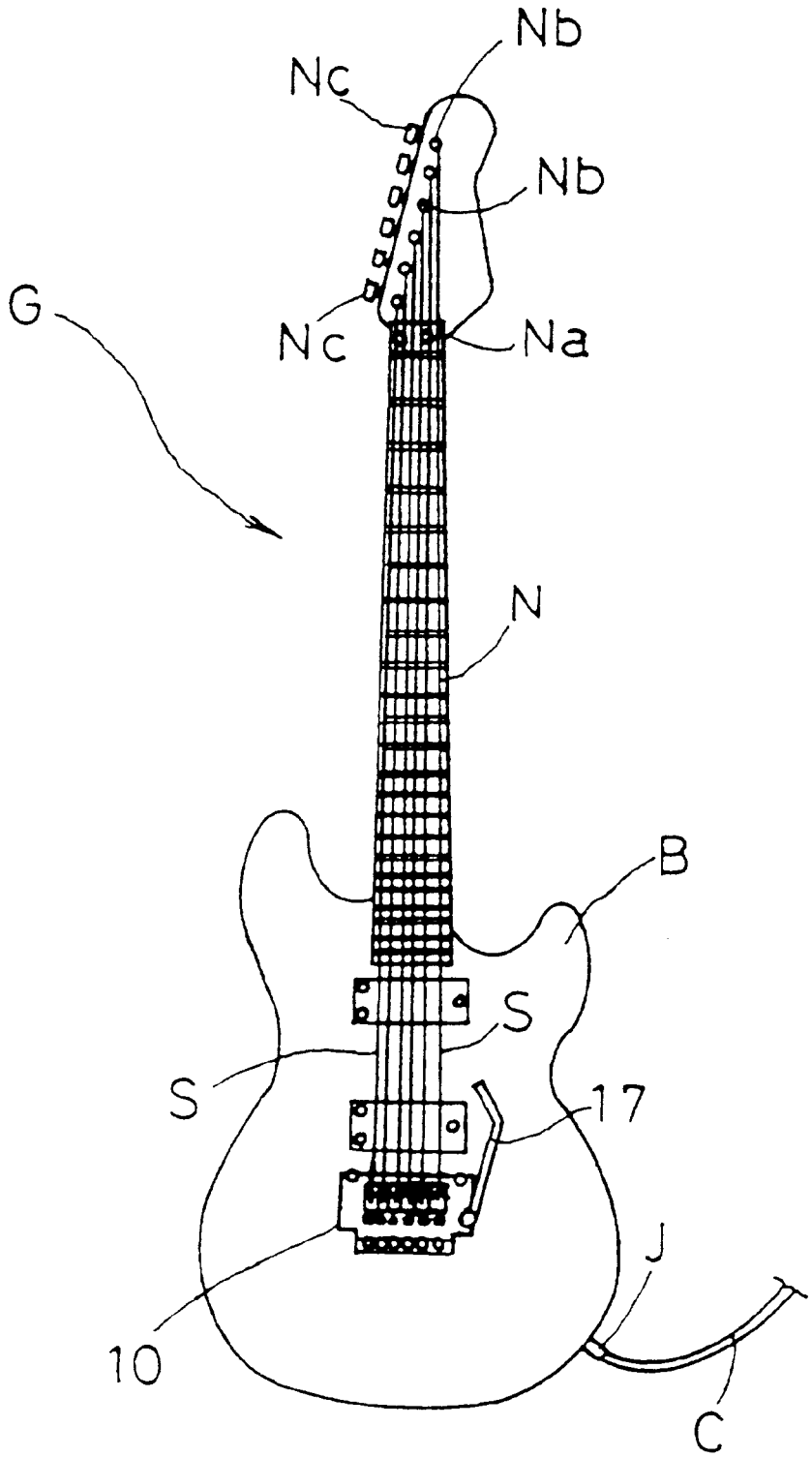
FIG. 1 shows a front view of an electric guitar having a tremolo bridge which is equipped with a piezo pickup according to the invention.

With reference to the drawings, an electric guitar shown in FIG. 1 has a guitar body B provided with a neck N and a nut Na located at the top end of the neck N. One end of each guitar string S is held and fixed by a string peg Nb at the nut Na, as is well known. Each string may be adjusted by a respective bobbin Nc which is linked to each string peg Nb, as is well known. At the opposite end of each string, a tremolo bridge 10 is located on the body B. The end of each string S, which is opposite to the nut Na end, is attached to the tremolo bridge 10. The tremolo bridge 10 has a tremolo arm 17 for providing a tremolo effect.

Figure 2:
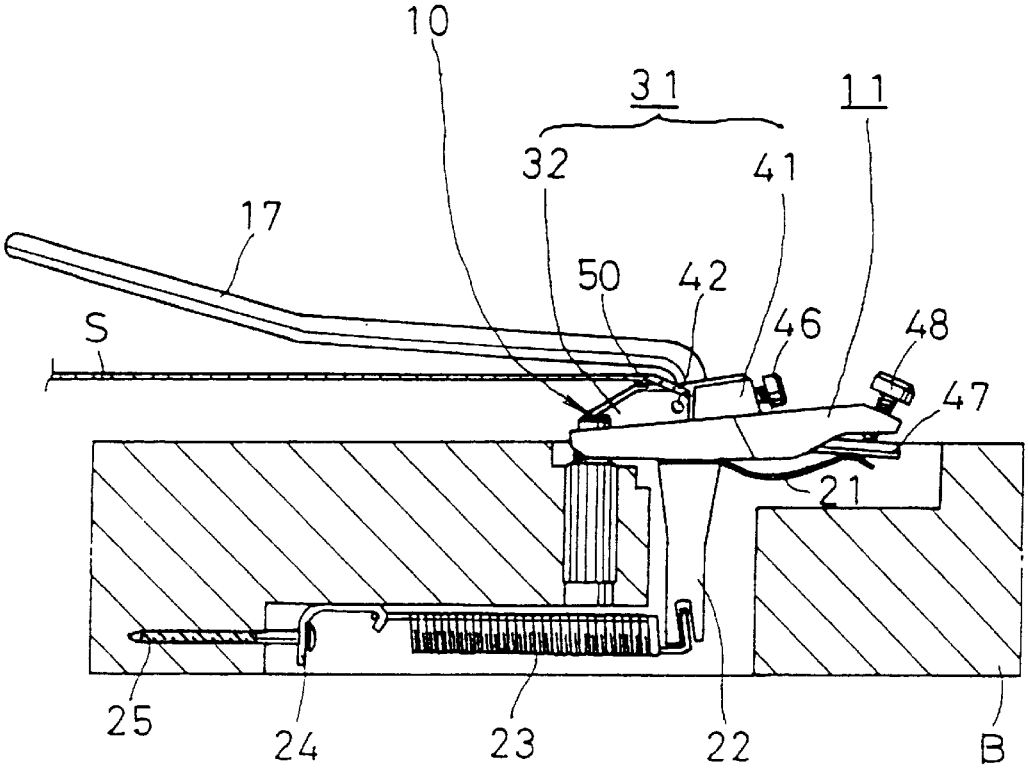
FIG. 2 is a partial cross section of a tremolo bridge of the guitar shown in FIG. 1 according to the invention.

In FIG. 2, a plate spring 21 biases a rotatable adjustment bar 47 of the bridge saddle 31. The tremolo block 22 is connected to a tremolo spring 23 which is fixed to the body B with a bracket 24. The bracket 24 is held by screws 25.

The tremolo bridge 10 comprises a base plate 11 which is installed so as to freely swing on the body B surface through a range of free swinging. A bridge saddle 31 having a main saddle body 41 that is rotatably adjustable in the forward and backward directions about an axle 42 on the saddle holding member 32 is provided on the base plate 11, as is shown in FIGS. 2 thorough 5.

As has earlier been explained with reference to the prior art tremolo bridge of FIGS. 13–16, the tremolo bridge 10 is capable of carrying out both or harmonic tuning or intonation adjustment and fine tuning effectively and, as compared with a tremolo bridge which is not of the locking type, it can reduce any out-of-tune performance when the tremolo is being used.

The tremolo bridge 10 has almost the same structure as the prior art tremolo bridge 10A that was explained in connection with FIGS. 13 through FIG. 16, except for the saddle holding member 32 of the bridge saddle 31. Therefore, the same reference numerals will be used for the same members and further detailed explanation is not provided.

The structure of the saddle holding member 32 of the tremolo bridge 10 of the invention is described below in detail.

FIG. 2 shows a first embodiment of the invention. A piezo pickup 50, which is capable of maintaining contact with the guitar string S that is held by the main saddle body 41, is provided at the top of the saddle holding member 32 in the swinging range of the base plate 11 (that range where the tension of the string S is weakened, when the bridge saddle 31 rises with the base plate from the guitar body), at least when the tremolo is being performed.

The piezo pickup 50 utilizes a piezo ceramic material known to those of skill in the art. It is used when electric amplification is required or the sounds of high frequencies are to be collected to produce a natural tone quality in the acoustic range.

Figure 11:
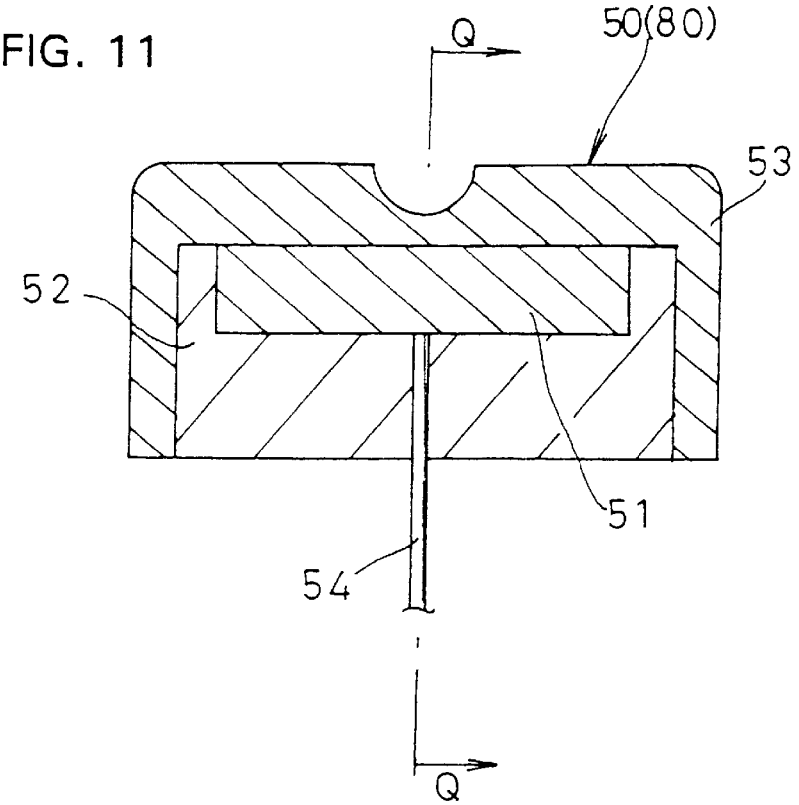
FIG. 11 is a cross section of a piezo pickup usable in the invention.
Figure 16:
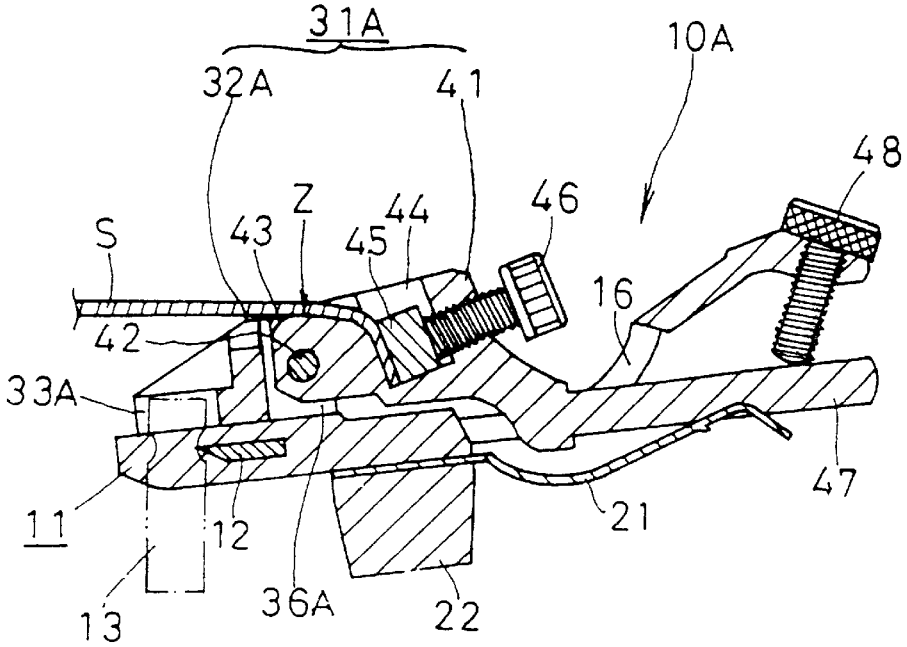
FIG. 16 PRIOR ART
FIG. 16 is a further cross section of the prior art tremolo bridge during a tremolo performance.
Figure 12:
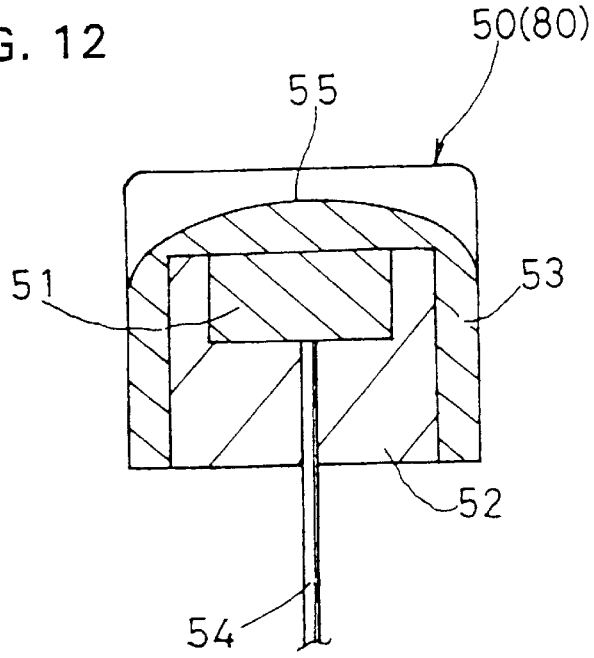
FIG. 12 is a cross section of the piezo pickup of FIG. 11 along line Q—Q of FIG. 11.
Figure 13:
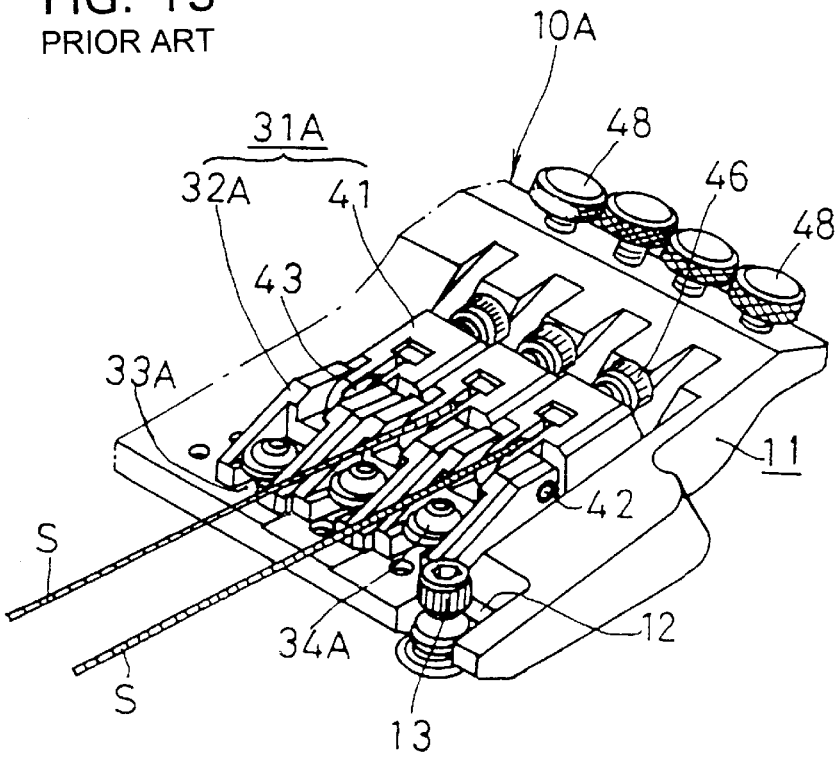
FIG. 13 PRIOR ART
FIG. 13 is a partial oblique view of a prior art tremolo bridge.
Figure 14:
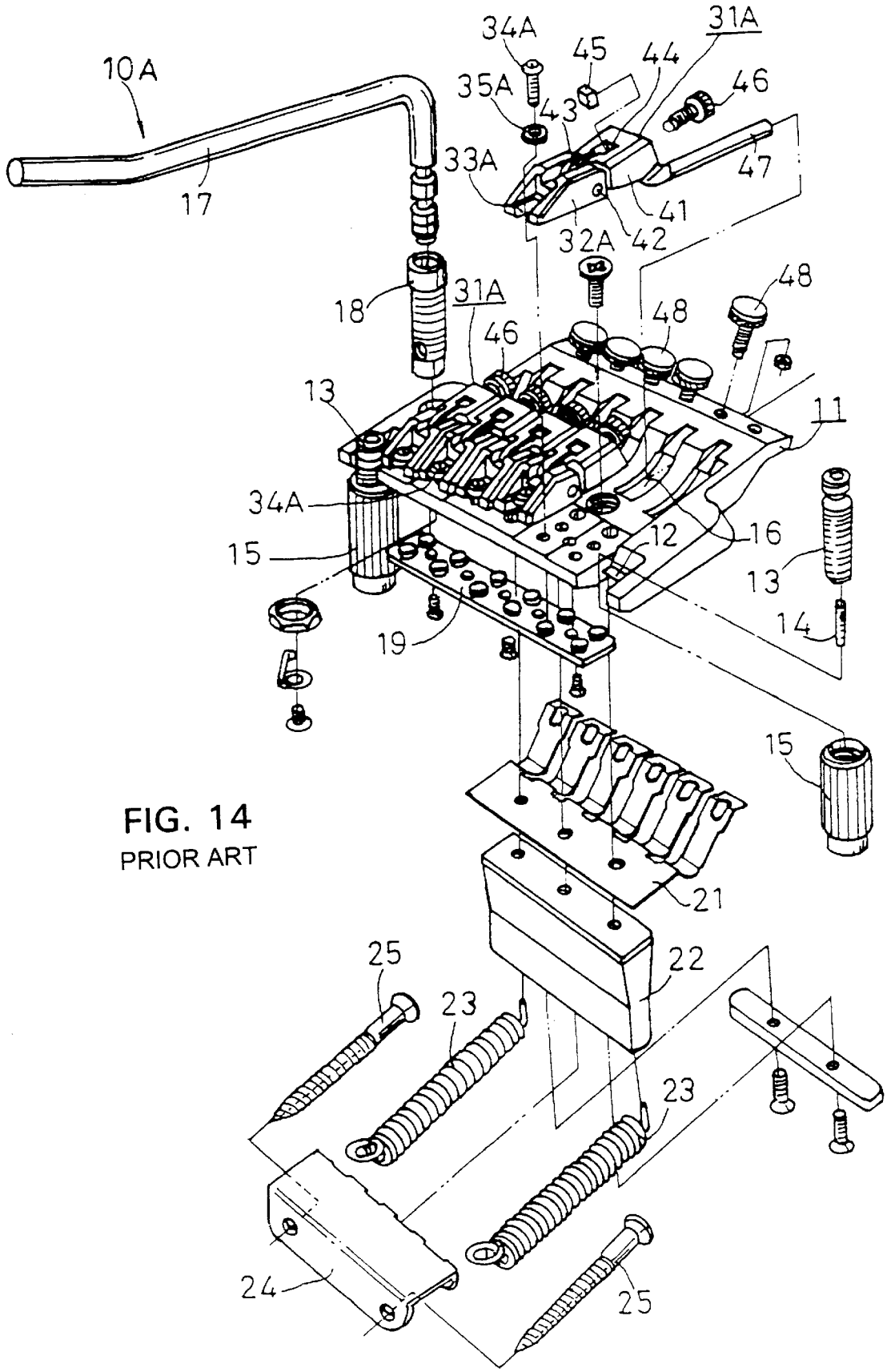
FIG. 14 PRIOR ART
FIG. 14 is a partially oblique exploded view of the prior art tremolo bridge of FIG. 13.
Figure 15A:
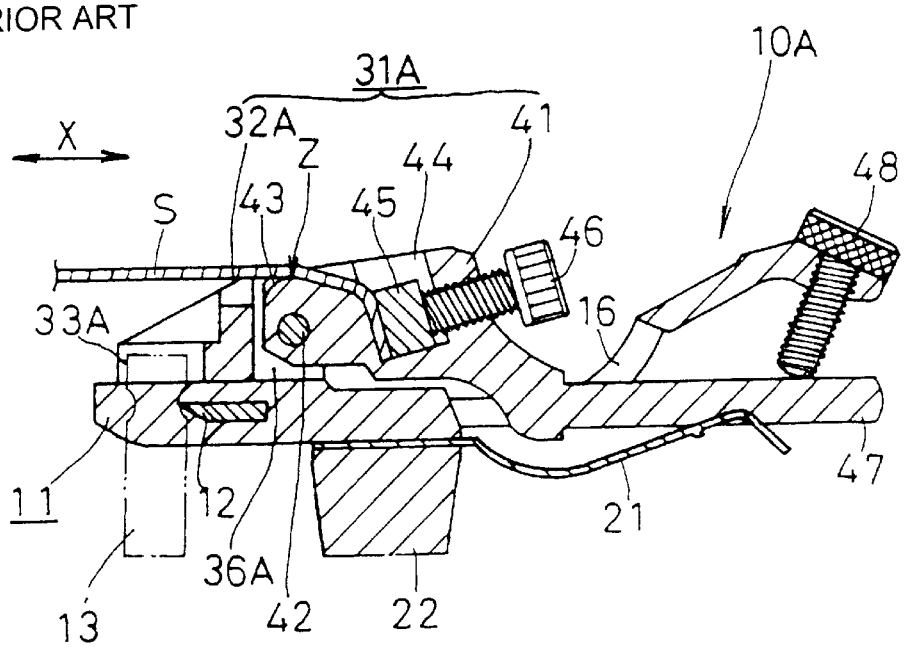
FIG. 15A PRIOR ART
FIGS. 15(A) and 15(B) are cross sections of the prior art tremolo bridge of FIG. 13 wherein the main saddle body is in two different positions during fine tuning.
Figure 15B:
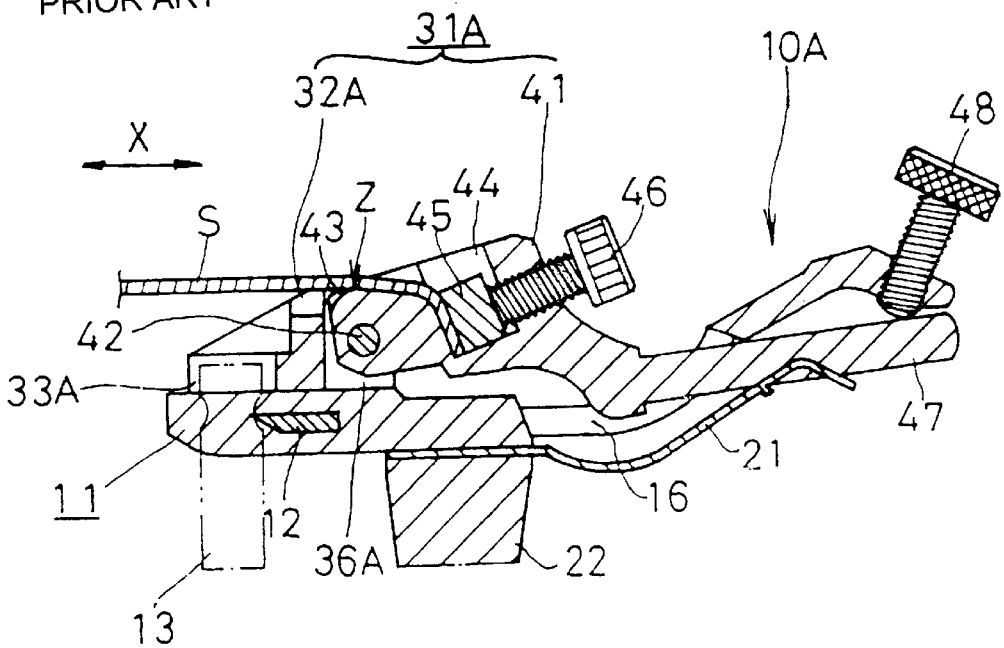
FIG. 15B PRIOR ART

In this embodiment of the invention, a piezo pickup 50 comprises a piezo ceramic material 51, a resin layer 52 made of, for example, an epoxy resin, etc., and metal casing 53, as shown in FIGS. 11 and 12. A lead wire 54 is connected to the piezo ceramic 51. In this example, a curved surface 55 is formed for contact with the string S at the top of the piezo pickup 50.

The piezo pickup 50 is intended to physically contact the string S and to contract and elongate in conformance with the pressure of the string vibration, for generating an electric current or voltage, with the voltage being used as a signal. The pickup can be used even when a string of a material, which is not a magnetic substance (e.g. steel iron), is used.

The lead wire 54 of the piezo pickup 50 is connected to an electronic device, such as an amplifier, etc. through a circuit plate (which is not shown in the drawing), a jack J and a cable C (FIG. 1).

Figure 3:
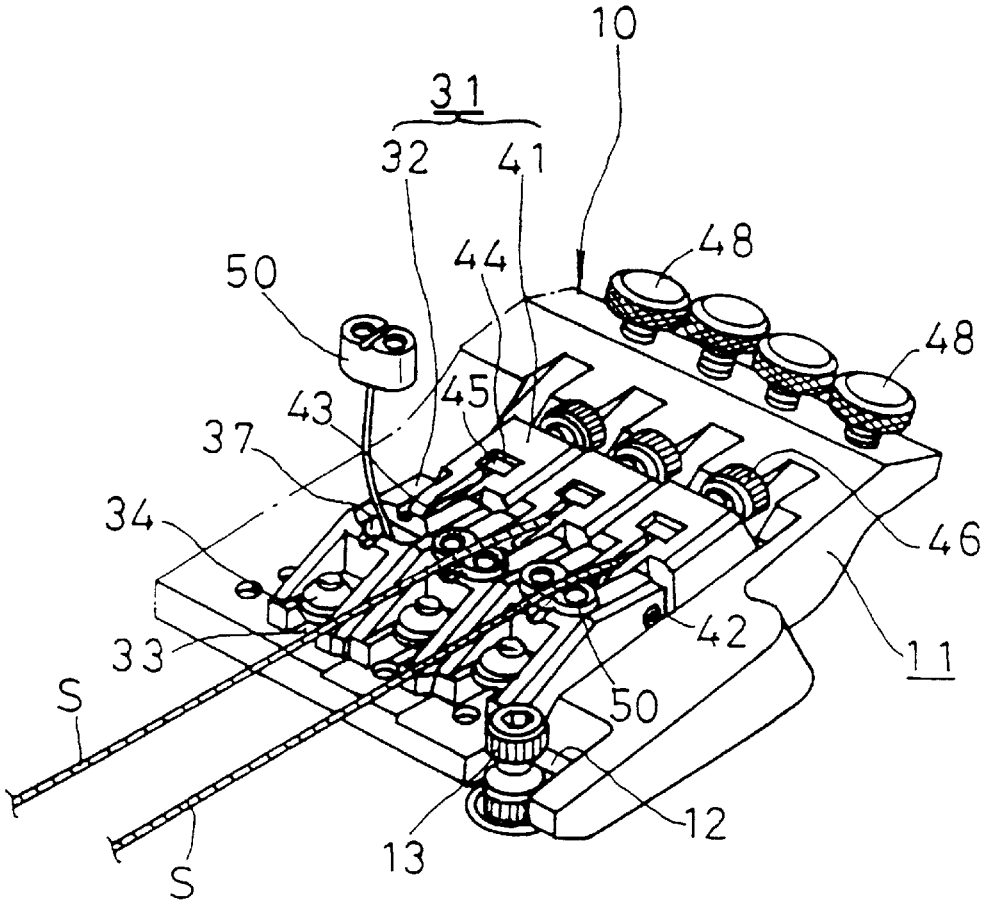
FIG. 3 is partial oblique view of the tremolo bridge of the guitar of the invention showing the structure of the bridge and the engagement of its components.
Figure 4A:
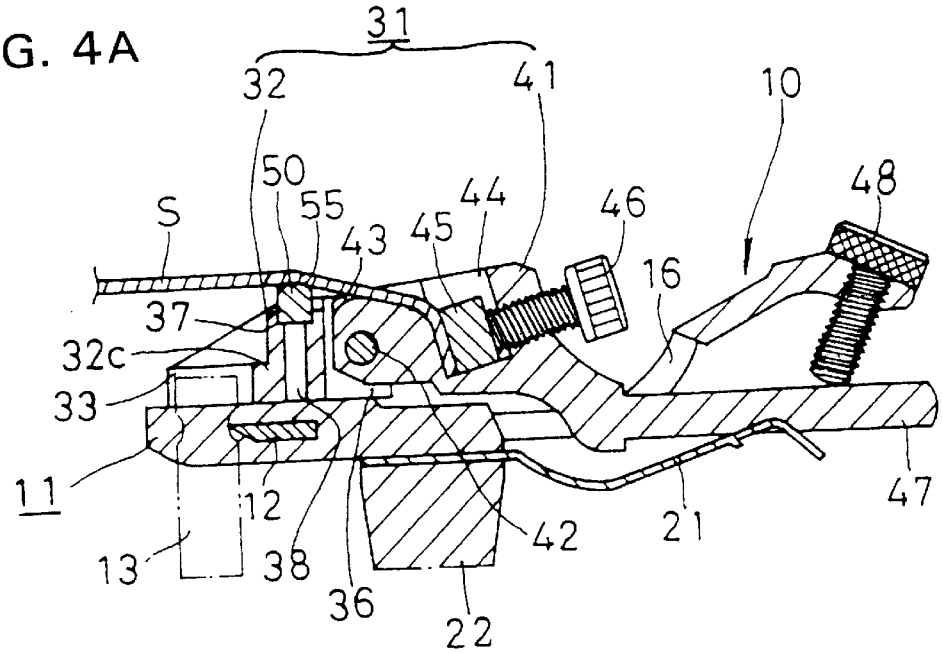
FIGS. 4(A) and 4(B) are cross sections of the tremolo bridge showing the main saddle body in two different positions during fine tuning.
Figure 4B:
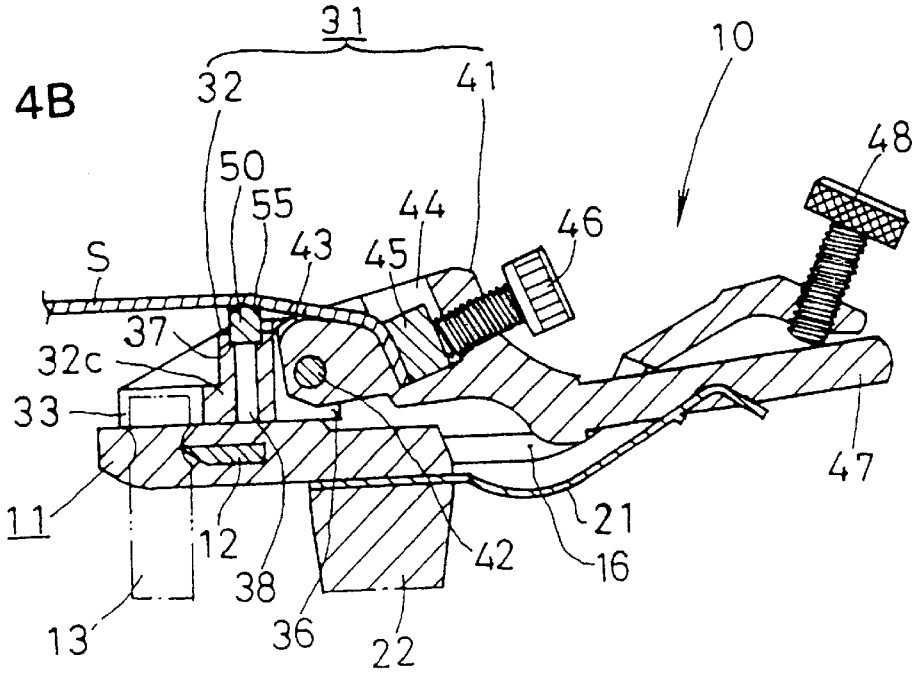
Figure 5:
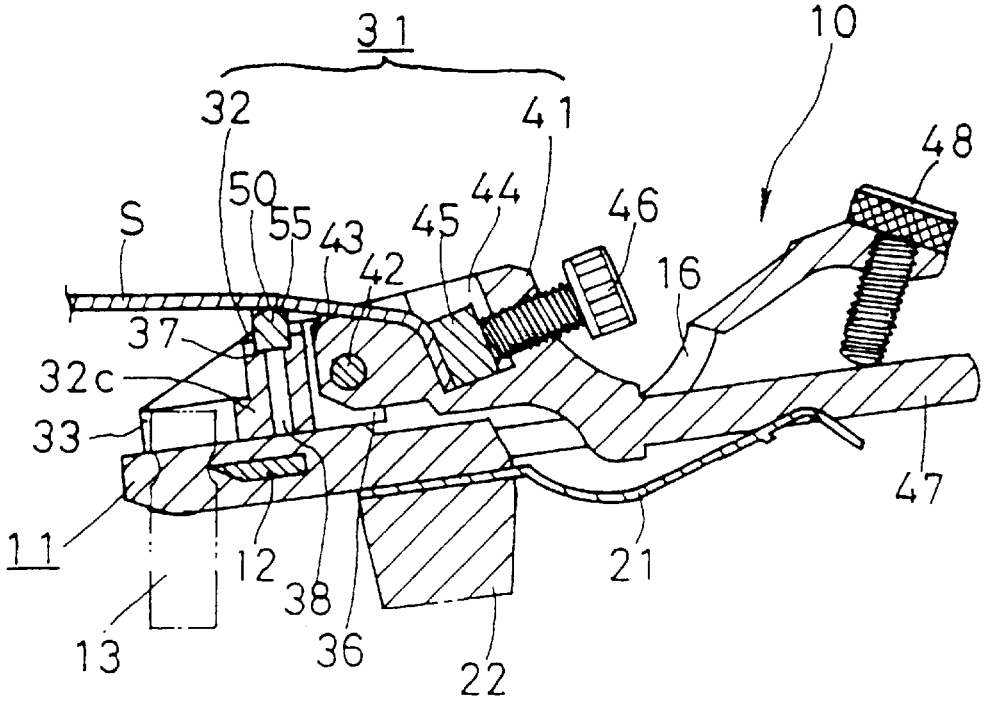
FIG. 5 is a further cross section of the tremolo bridge during a tremolo performance.

In FIGS. 3–5, a pickup receiver 37 is provided at the top of the central part 32*c* of the saddle holding member 32. That receiver 37 is between the installation groove 33 and the opening 36 for the accommodation of the front part of the main saddle body. The piezo pickup 50 is inserted into the receiver 37, making it possible for the piezo pickup 50 to be installed in the vicinity of the axle 42 of the main saddle body of the holding member 32.

By making the height of the upper surface of the piezo pickup 50 i.e., the height of its curved contact surface 55, higher than the maximum height of the front part of the main saddle body 41 or the height of the upper surface of the main saddle body 41 on the axial part 42 in the rotation adjustable range of the main saddle body 41, the piezo pickup 50 remains constantly in contact with the string S that is held by the main saddle body 41, at least in the rotation adjustable range of the main saddle body 41 and the possible free swinging range of the baseplate 11 during a tremolo performance.

In addition, a connecting hole 38 is provided at the bottom of the pickup receiver 37 for the wiring to the piezo pickup 50. A fixing bolt 34 fixes the saddle holding member 32 to the base plate 11 in the groove 33. As the fixing bolt 34 is loosened and as such related parts as the saddle holding member 32 and main saddle body 41, etc. are moved back and forth, the length of the string S can be adjusted or harmonic string adjustment can be carried out, as discussed previously.

Fine tuning of a specific string in an electric guitar is carried out in the following manner:

When the tension of a string is to be increased, the fine tuning bolt 48 is rotated for downward movement, for pressing the rotatable adjustment bar 47 downwardly, and the main saddle body 41 is rotated backward so as to shift from the state shown in FIG. 4(B) to the state shown in FIG. 4(A), through rotation of the main saddle body 41 in a backward direction.

When the tension of a string is to be decreased, on the other hand, the fine tuning bolt 48 is rotated to move upwardly. Accordingly, the rotatable adjustment bar 47 is moved upwardly, thereby rotating the main saddle body 41 in a forward direction so that the bridge shifts from the state shown in FIG. 4(A) to the state shown in FIG. 4(B).

In fine tuning, the above described structure is capable of preventing any possible change in the cord length as harmonically adjusted in conformity with the rotation of the main saddle body 41. In other words, even if the main saddle body 41 is rotated during fine tuning, the piezo pickup 50 that has been provided on the saddle holding member 32 at a location close to the axle 42 of the main saddle body 41 consistently remains in contact with the string S that is held by the main saddle body 41, at least over the possible free swinging range of the base plate 11 at the time of a tremolo performance, as described earlier. To be more specific, any possible change in the length of the string that has been harmonic tuned can be prevented and the state of the harmonic string tuning of the string S can be maintained without error during a tremolo performance, as contact with the pickup is carried out almost at the same position at all times.

If the height of the piezo pickup 50 is made higher than the height of the upper surface of the main saddle body 41 rotating on the axle 42, as in this example, it becomes possible to increase the angle of the forward inclination of the base plate 11 in the possible free swinging range of the base plate 11 at the time of a tremolo performance or at the time when the tension of the string S is weakened and it rises from the bridge saddle 31. This has the added advantage of increasing the tune change at the time of the tremolo performance. See FIG. 5, which shows the state of the bridge during a tremolo performance.

Another embodiment of this invention is now explained below.

Figure 6A:
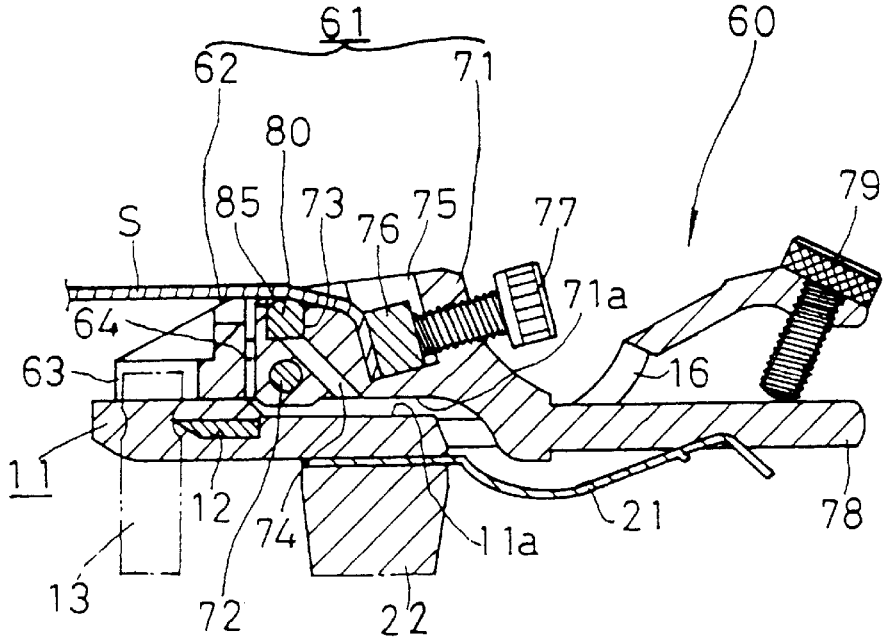
FIGS. 6(A) and 6(B) are cross sections of an alternative embodiment of the tremolo bridge of the guitar according to the invention in two different positions during fine tuning.
Figure 6B:
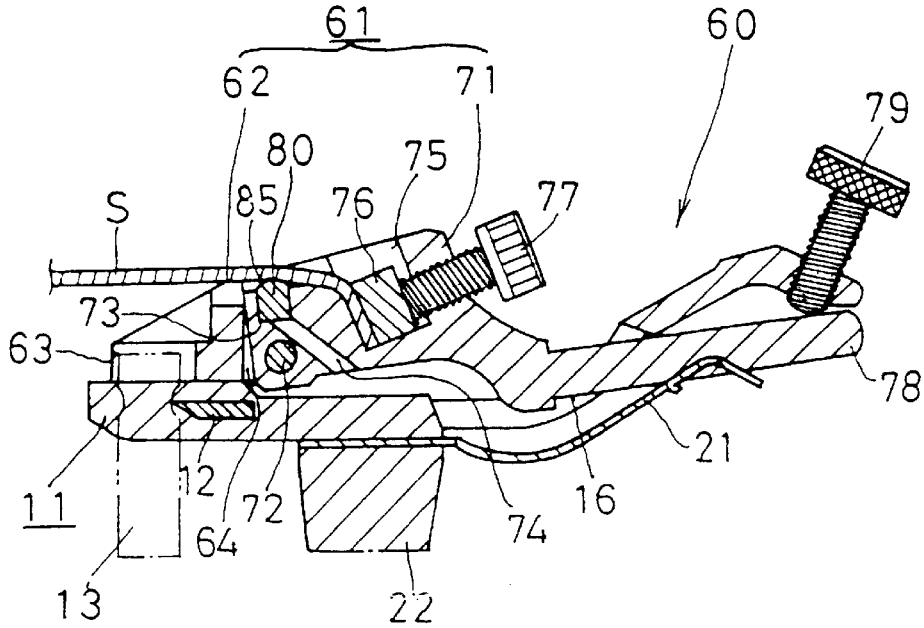
Figure 7:
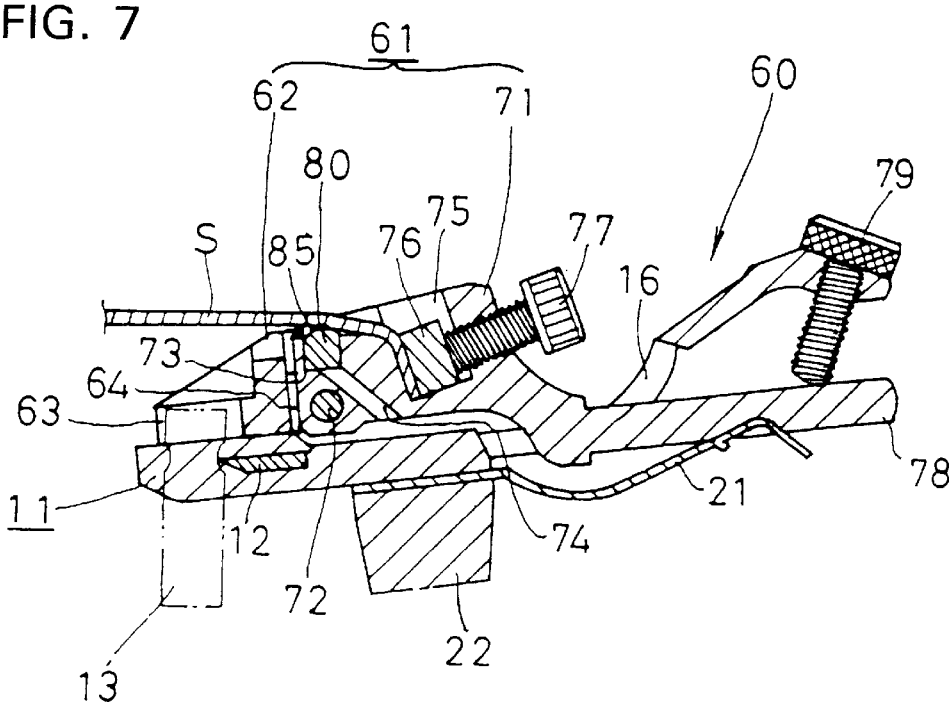
FIG. 7 is a further cross section of the tremolo bridge of FIGS. 6(A) and 6(B) during a tremolo performance.

The tremolo bridge 60 shown in FIGS. 6(A), 6(B) and 7 is a tremolo bridge of an electric guitar according to the second embodiment of the invention. It has a base plate 11 which is installed on the surface of the guitar body in such a way as to swing freely and a bridge saddle 61 which is held by the base plate 11 so as to permit the guitar strings to be tuned.

Figure 8:
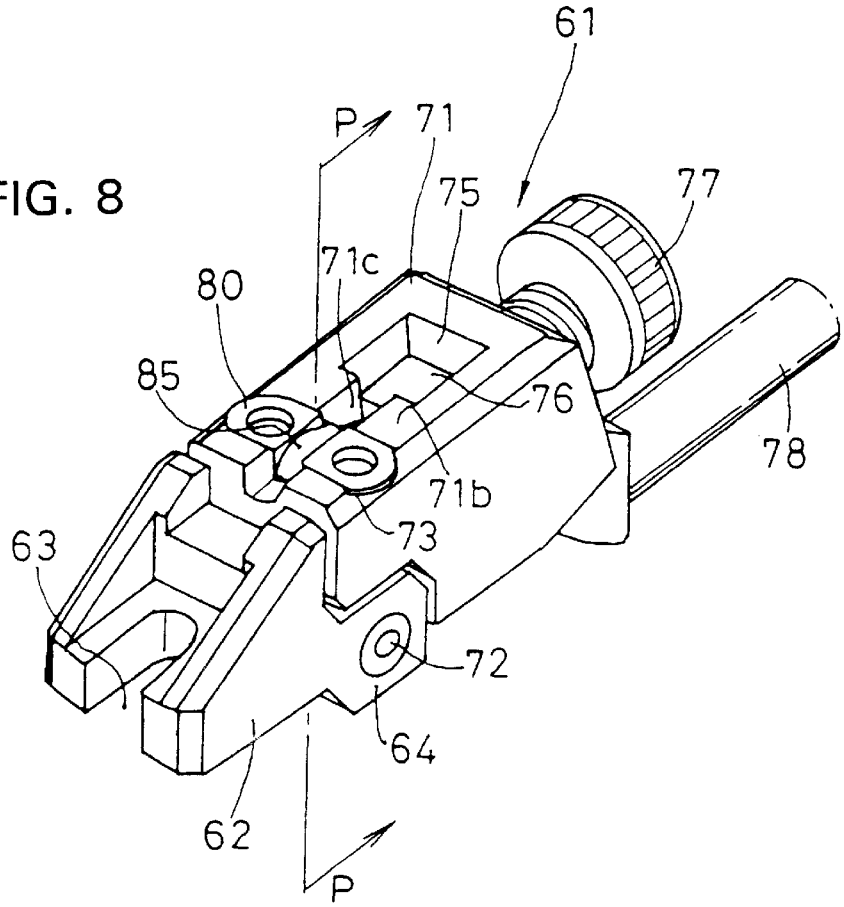
FIG. 8 is an expanded, partially oblique view of the bridge saddle of FIG. 7.
Figure 9:
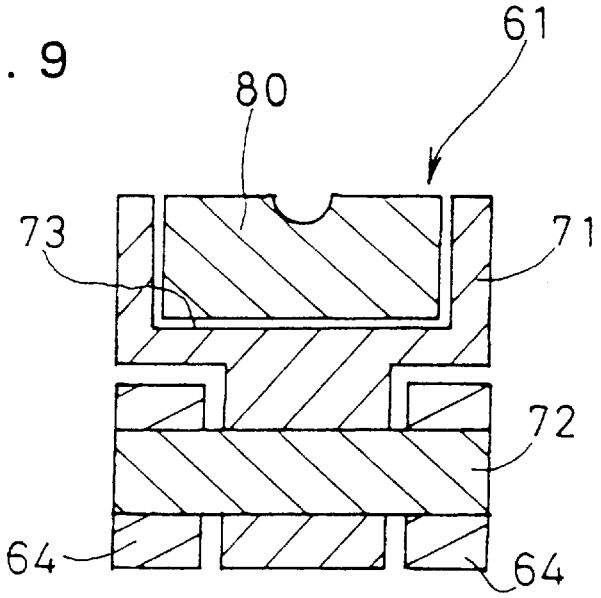
FIG. 9 is a cross section of the bridge saddle of FIG. 8 along the line P—P of FIG. 8.

As can be understood from FIGS. 6 to 8, the bridge saddle 61 comprises a saddle holding member 62 and a main saddle body 71 which is held on the saddle holding member 62 for rotation about an axle 72 such that rotatable adjustment is possible in the forward and rearward direction.

The structure of the base plate 11 of the tremolo bridge 60 in this example is approximately the same as that of the base plate of the prior art tremolo bridge 10A which was explained in connection with FIGS. 13 through 16. Therefore, the same parts have the same reference numerals and their detailed explanation is omitted.

The structure of the bridge saddle 61 of the tremolo bridge 60 is now described in detail.

In this tremolo bridge 60, a piezo pickup 80 is provided at the top of the main saddle body 71. It can contact a string S which is held on the main saddle body 71, at least over the possible free swinging range of the base plate 11 (the range over which the tension of the string S is weakened so as to rise up from the bridge saddle 61) at the time of a tremolo performance. A known piezo pickup 80 utilizing a piezo ceramic material, as in the piezo pickup 50 in the first embodiment, is employed.

In this example, however, the piezo pickup 80 is arranged immediately above the axle 72 of the main saddle body 71. The term "immediately above the axle 72" means on the line perpendicular to the upper surface 11*a* of the base plate 11 that passes through the center of the axle 72 of the main saddle body 71 when the base plate 11 is not swinging relative to the lower surface 71*a* of the main saddle body 71 and is approximately parallel to the upper surface 11*a* of the base plate 11 (as shown in FIG. 6(A)).

Placing the piezo pickup 80 immediately above the axle 72 of the main saddle body 71 in this manner makes it possible to reduce the distance between the piezo pickup 80 and the axle 72 of the main saddle body 71 and makes it possible to reduce the distance of the movement in the string direction of the piezo pickup 80 at the time of rotation of the main saddle body 71 during fine tuning.

Installing the piezo pickup 80 immediately above the axle 72 of the main saddle body 71 reduces the position or height of the axle 72 by the height of the piezo pickup 80, as compared with the height of the axle 42 in the example of FIGS. 1 to 5.

Installation of the above piezo pickup 80 is now explained. A pickup receiver 73 is provided immediately above the axle 72 of the main saddle body 71. As the piezo pickup 80 is inserted into the receiver 73, the piezo pickup 80 is installed on the main saddle body 71. Below the pickup receiver 73, there is a connecting hole 74 for the wiring to the piezo pickup 80 and the hole is directed to avoid the axle 72.

In this example, a groove 71*c* is formed along the string direction both before and after the pickup receiver 73 on the top surface 71*b* of the main saddle body 71. Also, the height of the upper surface of the piezo pickup 80 (i.e., the height of the curved contact surface 85 described below) is made higher than the height of the bottom of the groove 71*c* on the upper surface 71*b* of the main saddle body 71, as seen in FIG. 8. The top of the pickup is above the top of the saddle where the string engages both of them. This enables the piezo pickup 80 to be constantly in contact with the string S that is held by the main saddle body 71, at least in the possible free swinging range of the base plate 11.

In FIGS. 6 to 9, a groove 63 is provided for installing the saddle holder 62 on the base plate 11 to allow the holder 62 to move back and forth for fine tuning adjustment. A hinge 64 is provided on both sides of the hinge portion of the saddle holding member 62, and the lower part of the front of the main saddle body 71 is fixed by the hinge 64.

A concavity 75 in the main saddle body 71 is provided for fixing the cord. A block 76 fixes the cord. A bolt 77 fixes the cord by holding the string fixing block 76. A rotatable adjusting bar 78 and a fine tuning bolt 79 rotates the main saddle body 71 through the vertical movement, as it remains in contact with the adjusting bar 78.

Figure 10:
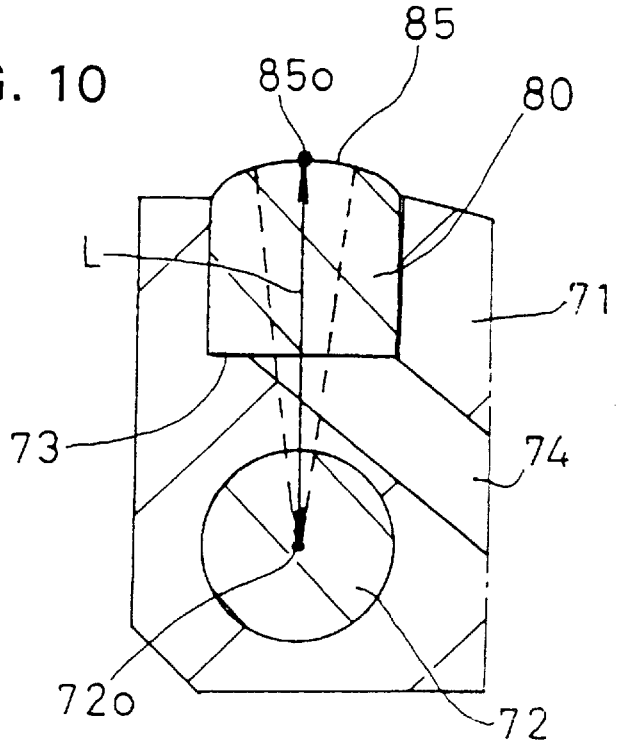
FIG. 10 is an expanded partial cross section showing the relationship between the piezo pickup and the axial part of the main saddle body taken along a vertical central section line in FIG. 9.

In FIG. 10, the piezo pickup 80 has a curved surface 85 for contact with the string S at the top. The cross sectional shape of the curved contact surface 85 is an arc, having its center of rotation parallel to and as the center 72*o* of the axle 72 of the main saddle body 71 or, described otherwise, an arc having as its radius the distance L between the center 72*o* of the axle 72 of the main saddle body 71 and the center 85*o* of the curved contact surface 85 of the piezo pickup 80.

Even when the piezo pickup 80 itself rotates in conformity with the rotation of the main saddle body 71, the contact position between the piezo pickup 80 and the string S is always approximately along the perpendicular line to the upper surface of the base plate 11 that passes through the center of the axle 72 of the main saddle body 71. In addition, the range of the curved contacting surface 85 as described earlier, is sufficiently in the range of possible rotation of the main saddle body 71 as required at the time of fine tuning (i.e., the range which is contained within the two broken radial lines extending from the center 72*o* of the axial part 72 in FIG. 10).

Fine tuning of a specific string in this example is carried out in the same manner as described, for example, in connection with FIGS. 1 to 5. To increase the tension of the string, the fine tuning bolt 79 is rotated to move downward, thereby pressing the adjusting bar 78 for rotation downward, with the main saddle body 71 being rotated backward so as to change from the state shown in FIG. 6(B) to the state shown in FIG. 6(A).

When the tension of the string is to be reduced, on the other hand, the fine tuning bolt 79 is rotated to move upward, thereby moving the adjusting bar 78 up, with the main saddle body 71 being rotated forward so that the state shown in FIG. 6(A) changes to the state shown in FIG. 6(B). This example also makes it possible to obtain the tremolo effect for a modification of the sound range of the guitar by swinging the base plate 11, with the stud bolt 13 as the fulcrum, in opposition to the force of the tremolo spring, as shown in FIG. 7.

In the structure described above, even when the main saddle body 71 is rotated during fine tuning, the piezo pickup 80 contacts the string S, which is held by the main saddle body 71, at all times approximately at the same location or, to be more specific, on a line perpendicular to the upper surface of the base plate 11 that passes through the center of the axle of the main saddle body 71 or in its vicinity.

Accordingly, it is possible to prevent any change in the length of the string that has been harmonically adjusted by the rotation of the main saddle body 71 and prevent any out-of-tune situation in the string S.

According to the invention which has been explained above, an electric guitar equipped with a piezo pickup can be capable of preventing any change in the length of the strings as a result of rotation of the main saddle body in connection with fine tuning and of preventing any possible out-of-tune situation in the harmonically tuned state of the strings, including during a tremolo performance.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An electric guitar comprising:

a guitar body including guitar string support elements for supporting guitar strings to extend in a direction over the body and a string holding member;

a base plate swingably mounted on the guitar body for swinging through a free swinging range with respect to the body around a first axis across the strings;

a bridge saddle on the base plate comprising a saddle holding member and a main saddle body;

the saddle holding member having a top portion;

the main saddle body including elements for fixing an end of a guitar string; the main saddle body being mounted to the saddle holding member at an axle which extends across the direction of the strings and being rotatably adjustable in a forward and backward direction about the axle on the saddle holding member thereby to allow a fine tuning adjustment of the guitar string; and a piezo pickup so shaped and so located at the top portion of the saddle holding member that the piezo pickup is in contact with the guitar string at a contact point, the guitar string being fixed by the main saddle body, at least over the free-swinging range of the base plate;

wherein the contact point moves together with said string holding member during intonation adjustment.

2. The electric guitar of claim 1, wherein the piezo pickup has an upper surface that is higher than a front part of the main saddle body.

3. The electric guitar of claim 1, wherein the piezo pickup is disposed alongside a line extending though the axis of rotation of the main saddle body and perpendicular to a surface of the base plate.

4. The electric guitar of claim 3, wherein the piezo pickup is disposed in the saddle holding member and is not rotatable with the main saddle body about the axis of rotation of the main saddle body.

5. The electric guitar of claim 1, wherein the piezo pickup is disposed in the main saddle body and is rotatable with the main saddle body about the axis of rotation of the main saddle body.

6. The electric guitar of claim 1, wherein the base plate is pivotable through the free swinging range to provide a tremolo effect.

7. The electric guitar of claim 1, wherein the piezo is so shaped and placed that the string contacts the piezo pickup approximately at the same location on the piezo pickup during a fine tuning adjustment of the string.

8. The electric guitar of claim 1, wherein the piezo pickup has an upper surface for contacting the string and the upper surface is above an uppermost surface of the saddle holding member and is in line with the string and the main saddle body having an uppermost surface contacting the string.

9. An electric guitar comprising:

a guitar body including guitar string support elements for supporting guitar strings to extend in a direction over the body and a string holding member;

a base plate swingable mounted on the guitar body for swinging through a free swinging range with respect to the body around a first axis across the strings;

a bridge saddle on the base plate comprising a saddle holding member and a main saddle body;

the saddle holding member having a top portion;

the main saddle body including elements for fixing an end of a guitar string; the main saddle body being mounted to the saddle holding member at an axle which extends across the direction of the strings and being rotatable adjustable in a forward and backward direction about the axle on the saddle holding member thereby to allow a fine tuning adjustment of the guitar string; and a piezo pickup so shaped and so located above the axle of the main saddle body that the piezo pickup is in contact with the guitar string at a contact point, the guitar string being fixed by the main saddle body, at least over the free-swinging range of the base plate;

wherein the contact point moves together with said string holding member during intonation adjustment.

10. The electric guitar of claim 9, wherein the piezo pickup has an upper surface that is curved convexly around an axis across the direction of the string and positioned for contact with the guitar string.

11. The electric guitar of claim 9, wherein the piezo pickup is so shaped and so disposed above the axis of rotation of the main saddle body that the string contacts the piezo pickup approximately at the same location on the piezo pickup during the fine tuning adjustment of the string.

12. The electric guitar of claim 11, wherein the piezo is so shaped and placed that the string contacts the piezo pickup at a point on the piezo pickup defined by a line perpendicular to an upper surface of the base plate that passes approximately through a center of the axis of rotation of the main saddle body.

* * * * *